US005754937A

United States Patent [19]

Jones et al.

[11] Patent Number: 5,754,937

[45] Date of Patent: May 19, 1998

[54] HI-DENSITY FORMING PROCESS

[75] Inventors: Peter Jones, Toronto; Roger Lawcock, Burlington, both of Canada

[73] Assignee: Stackpole Limited, Mississauga, Canada

[21] Appl. No.: 644,978

[22] Filed: May 15, 1996

[51] Int. Cl.[6] ..... B22F 3/12

[52] U.S. Cl. ..... 419/38; 419/11

[58] Field of Search ..... 419/11, 38

[56] References Cited

U.S. PATENT DOCUMENTS

| | | | |
|---|---|---|---|
| 5,019,156 | 5/1991 | Naya et al. | 75/245 |
| 5,178,691 | 1/1993 | Yamashita et al. | 148/101 |
| 5,427,660 | 6/1995 | Kamimura et al. | 204/130 |
| 5,476,632 | 12/1995 | Shivanath et al. | 419/57 |

OTHER PUBLICATIONS

Yoshiaki Itoh et al in the SAE Technical Paper Series, given at the International Congress and Exposition in Detroit, Michigan on Feb. 27–Mar. 3/1989 entitled "Inmprovement of the Rolling Contact Fatigue Strength of Sintered Steel for Transmission Component".

*Primary Examiner*—Charles T. Jordan
*Assistant Examiner*—Daniel Jenkins
*Attorney, Agent, or Firm*—Eugene J.A. Gierczak

[57] ABSTRACT

A method for making a high density powdered metal article is provided. The composition consists of iron based powder, lubricant, graphite and ferro alloy additions. The composition is compacted in rigid tools at ambient temperature, sintered at high temperature and then formed in rigid tools at 40 to 90 tons per square inch to a density greater than 94% of theoretical. The high density article is then annealed. The final article demonstrates remarkable mechanical properties which are atypical of powdered metal components and approach those of wrought steel.

16 Claims, 12 Drawing Sheets

| | FeCMn 7.5 g/cc | FC0200[1] 6.9 g/cc | AISI 1020 7.8 g/cc |
|---|---|---|---|
| Tensile Strength, ksi | 60 | 34 | 62 |
| Yield Strength, ksi | 40 | 29 | 34 |
| Elastic Modulus, ksi | 25,500 | 19,000 | 29,000 |
| Elongation, % | 23 | 2 | 23 |
| Hardness, HRB | 60 | 36 | 70 |
| Impact Strength , ft lb unnotched | >120 | 6 | >120 |
| Fatigue Strength, ksi alternating stress unnotched, R=0 | 28 | 13 | 30 |
| Fatigue Ratio[2] | 0.46 | 0.38 | 0.48 |

Notes
1) MPIF Standard 35 1994 designation for a low carbon and low alloy material
2) Ratio Of Fatigue Strength to Tensile Strength

FIGURE 12

HI-DENSITY FORMING PROCESS

FIELD OF INVENTION

The invention relates to methods of forming sintered compacts of low alloy steel composition to high density at ambient temperature. The invention further relates to specific compositions of iron based powder metal sintered compacts which may be formed to high density.

BACKGROUND OF THE INVENTION

To those appreciative of the art of manufactured PM articles, the achievement of high density is of significant importance. High density generally significantly improves the strength and durability characteristics of the manufactured article. The amount of residual porosity in relation to powder metal sintered articles of low alloy steel type compositions has a profound influence on the loading conditions that the article can withstand in its operation. At high levels of residual porosity (i.e. low density) manufactured articles are brittle and of low fatigue strength. Such low density articles can generally only be used in applications where service loading is relatively light. The available market for low density PM compacts is therefore restricted. At lower levels of residual porosity (i.e. high density), the manufactured articles become ductile and of significantly greater fatigue strength. The manufacture of low alloy PM articles at relatively high density is therefore attractive because increased market share can be achieved due to improved properties of the article.

Several prior art methods and procedures such as hot forging or double pressing and double sintering for example have been developed with the objective of increasing density for the reasons referred to above. However many of these processes have drawbacks which hinder their use for the economic production of articles in high volumes. Such drawbacks may include the requirement to use high temperatures during forming, which leads to high die wear costs, and associated dimensional accuracy problems. High cost raw materials may be used, such as fine powders. For example the metal injection molding process (MIM) uses iron of about 10 microns in size which can be used to manufacture high density articles; however the economics of the process are adversely affected because of the high cost of the raw material. Processes such as hot isostatic pressing (HIP) or pressure assisted sintering (PAS) are examples where high temperatures and high gas pressures may be used during sintering. However such equipment has throughput limitations and dimensional precision is difficult to control.

For a process to be of commercial value and offer a significant improvement in durability of the sintered powdered part the method of producing high density sintered powder metal parts should meet the following criteria:

- use low cost raw materials
- be suited to high volume production rates
- produce articles of high precision
- have acceptable tool life characteristics
- produce articles with a density in the range of 94% to 98% theoretical full density of wrought iron (equivalent to a range of 7.4 to 7.7 g/cc for low alloy compositions).

The use of a prealloyed powder is discussed by Yoshiaki et al in the SAE Technical Paper Series, given at the International Congress and Exposition in Detroit, Mich. on Feb. 27–Mar. 3, 1989, which is entitled "Improvement Of The Rolling Contact Fatigue Strength of Sintered Steel for Transmission Component". However, the base iron powder utilized herein has a lower cost.

It is an object of this invention to provide an improved method to produce powder metal parts having high density and ductility.

It is an aspect of this invention to provide a method of forming sintered powder metal articles to a high density by forming the sintered powder metal in a closed die cavity having a clearance for movement of said sintered powder metal to final shape with increased density after compression, wherein the formed sintered powder metal part has a compressed length of approximately 3 to 30% of the original length.

It is another aspect of this invention to produce a method of forming sintered powder metal article by blending carbon; at least one ferro alloy powder selected from the group of ferro chromium, ferro manganese, ferro molybdenum, and a lubricant, with iron powder to form a blended mixture; pressing the blended mixture to form the article; sintering the article at a temperature greater than 1250° C.; forming the sintered article in a closed die cavity having a clearance so as to produce a formed sintered powder metal part having a compressed length of approximately 3 to 19% of the original length when subjected to a pressure between 40 and 90 tons per square inch so as to increase the density of the formed sintered article; annealing the formed sintered article at a temperature greater than 800° C. in a reducing or carburizing atmosphere or vacuum.

It is a further aspect of this invention to provide a method of making a high density sintered powder metal article, comprising the steps of blending iron powder with ferro alloys, graphite and lubricant to provide a selected chemical composition for the finished article having at least one of the following: 0 to 0.5% carbon, 0 to 1.5% manganese, 0 to 1.5% molybdenum and 0 to 1.5% chromium and the remainder iron powder with unavoidable impurities; compacting the metal powder mixture in a rigid die to a density of approximately 90% of theoretical full density; sintering the compacted article at a temperature greater than 1250° C. in a reducing atmosphere or vacuum; forming the sintered article in rigid tools at pressure in the range of 40 to 90 tons per square inch to a density in excess of 94% of theoretical full density; annealing the high density article at a temperature greater than 800° C. in a reducing or carburizing atmosphere or vacuum, where the total alloy composition is between 0 to 2.5% by weight to the total weight of sintered powder metal article.

DRAWINGS

These and other objects and features of this invention shall now be described in relation to the following drawings:

FIG. 12 is a high density forming property comparison.

SUMMARY OF THE INVENTION

Figure 1:
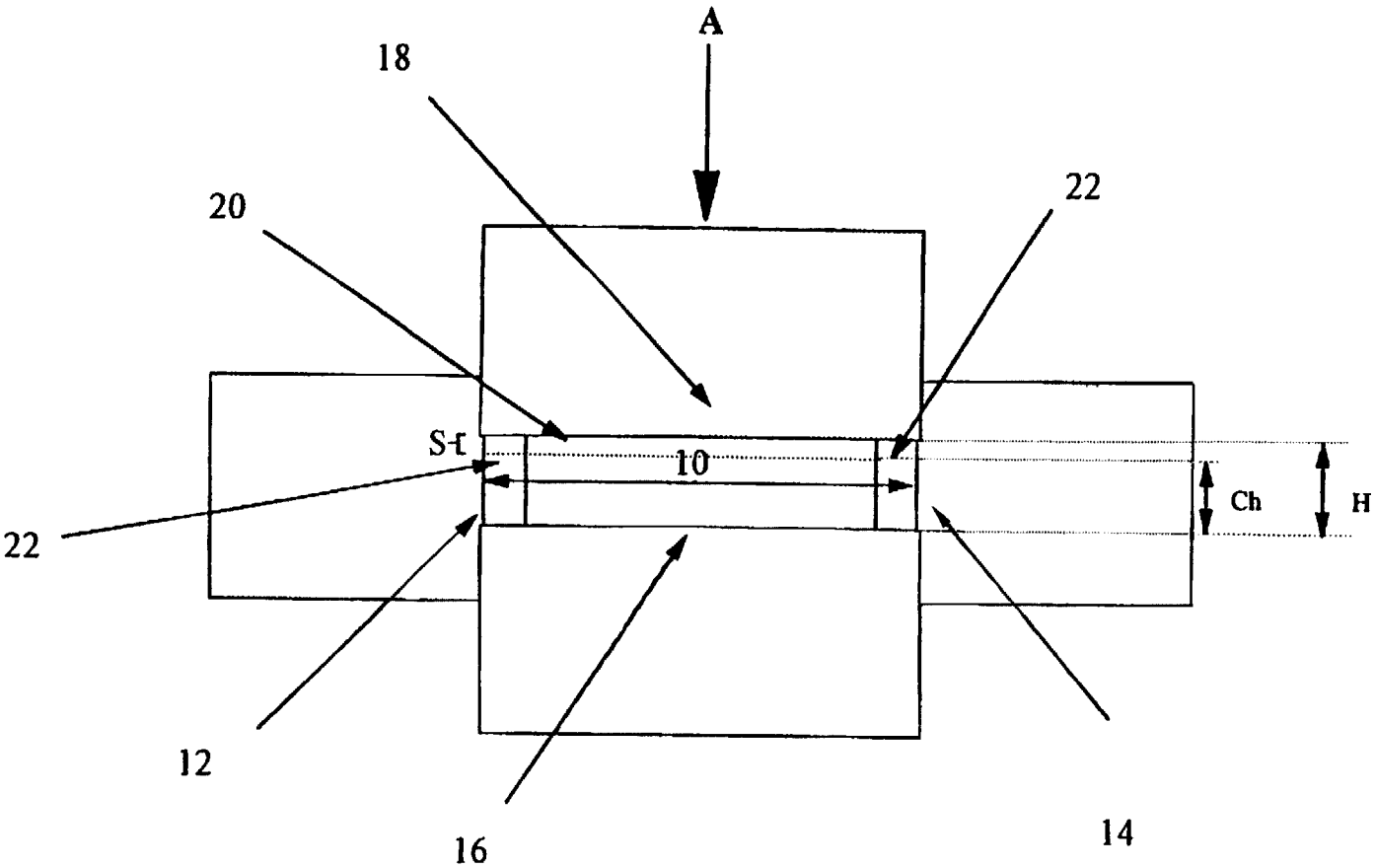
FIG. 1 is a cross sectional view of the forming process.

The present invention describes a method of forming sintered powder metal compacts to a density in the range of 7.4 to 7.7 g/cc. The compositions of the final articles are of a low alloy steel distinction where the carbon content is less than 0.5% and preferably less than 0.3% by weight of the sintered article and have formable characteristics. The forming is preferably carried out at ambient temperatures (although elevated temperatures could be used) which provides acceptable tooling life and excellent precision features.

The process utilizes low cost iron powders which are blended with calculated amounts of ferro alloys, graphite and lubricant such that the final desired chemical composition is achieved and the powder blend is suited to compaction in rigid compaction dies. The process is generally described in U.S. Pat. No. 5,476,632.

Compaction may be performed in the regular manner whereby the blended powder will be pressed into a compact to around 90% of theoretical density.

Sintering is undertaken at high temperatures generally greater than 1250° C. such that oxides contained within the compact are reduced. No significant densification occurs during the sintering process. The density of the sintered compact will still be around 90% of theoretical.

Forming as defined herein includes:

(a) sizing—which may be defined as a final pressing of a sintered compact to secure a desired size or dimension;

(b) coining—which can be defined as pressing a sintered compact to obtain a definite surface configuration;

(c) repressing—which can be defined as the application of pressure to a previously pressed and sintered compact, usually for the purpose of improving physical or mechanical properties and dimensional characteristics;

(d) restriking—additional compacting of a sintered compact.

Forming to high density is carried out in regular rigid dies using conventional repressing/sizing/coining/restriking/stamping presses. Forming to high density is accomplished by the selection of the composition of the sintered compact, by the selection of pressure used in the forming operation, and by the selection of the forming tool so as to provide clearance in the tools for movement of the sintered compact to final shape. After the forming operation the article will have a density in the range of 94% to 98% of the theoretical. The actual final density may be precisely controlled by controlling the composition of the sintered article and by controlling the forming pressure.

Subsequent to the forming step, in order to fully develop the desirable mechanical properties, the article is annealed, at elevated temperature, and in a suitable atmosphere, in order to form metallurgical bonding throughout the formed article. Annealing conditions used, such as, atmosphere, temperature, time and cooling rate can be selected and varied to suit the specific final function of the manufactured article.

DETAILED DESCRIPTION OF THE INVENTION

A method of making a sintered powdered metal article having high density and ductility with improved mechanical properties is herein described. The present invention employs low carbon steel compositions that, after sintering, may be formed to high density at ambient temperature. The carbon utilized herein has a composition of less than 0.5% and preferably less than 0.3% by weight of the final sintered article.

The compositions of the powdered metal articles that are the subject of this invention are of the kind not generally employed in the powdered metal industry. Prior art compositions generally included the use of alloys consisting of iron, carbon, copper, nickel and molybdenum. In this invention, alloys of iron, such as manganese, chromium and molybdenum are used and are added as ferro alloys to the base iron powder as described in U.S. Pat. No. 5,476,632, which is incorporated hereby by reference. Carbon is also added. The alloying elements ferro manganese, ferro chromium, and ferro molybdenum may be used individually with the base iron powder, or in any combination, such as may be required to achieve the desired functional requirements of the manufactured article. In other words two ferro alloys can be used or three ferro alloys can be blended with the base iron powder. Examples of such base iron powder includes Hoeganaes Ancorsteel 1000/1000B/1000C, Quebec Powder Metal sold under the trade marks QMP Atomet 29 and Atomet 1001.

The base iron powder composition consists of commercially available substantially pure iron powder which preferably contains less than 1% by weight unavoidable impurities. Additions of alloying elements are made to achieve the desired properties of the final article. Examples of compositional ranges of alloying elements that may typically be used include at least one of the following: 0 to 0.5% carbon, 0 to 1.5% of manganese, 0 to 1.5% chromium and 0 to 1.5% of molybdenum where the % refers to the percentage weight of the alloying element to the total weight of the sintered product and the total weight of the alloying elements is between 0 to 2.5%. The alloying elements Mn, Cr, and Mo are added as ferro alloys namely FeMn, FeCr, FeMo. The particle size of the iron powder will have a distribution generally in the range of 10 to 350 μm. The particle size of the alloying additions will generally be within the range of 2 to 20 μm. To facilitate the compaction of the powder a lubricant is added to the powder blend. Such lubricants are used regularly in the powdered metal industry. Typical lubricants employed are regular commercially available grades of the type which include, zinc stearate, stearic acid or ethylene bistearamide.

The formulated blend of powder containing iron powder, carbon, ferro alloys and lubricant will be compacted in the usual manufacturing manner by pressing in rigid dies in regular powdered metal compaction presses. Compacting pressures of around 40 tons per square inch are typically employed which will produce a green compact with a density of approximately 90% of theoretical density of wrought iron. At the compaction stage the article will be substantially formed to its final required shape. Dimensional features are not quite to final specifications because allowances are made for dimensional changes which will occur during subsequent processing.

The compacted article is then sintered at high temperature, in excess of 1250° C. while a reducing atmosphere or a vacuum is maintained around the article. In the sintering process, contacting particle boundaries become metallurgically joined and impart strength and ductility to the sintered article. In addition, the reducing atmosphere causes a reduction of oxides from both the iron powder and the alloying element additions. The chemical reduction process provides for clean particle surfaces which enhance the metallurgical bonding of the particles, and most importantly, allows for uniform diffusion of the alloying elements into the iron particles. The final sintered article will then contain a homogeneous or near homogeneous distribution of alloying elements throughout the microstructure. A sintering method, or choice of alloying which promotes a non homogeneous microstructure is considered to be undesirable. A non homogeneous microstructure will contain a mixture of hard and soft phases which will adversely affect the forming characteristics of the sintered article.

Generally speaking, on sintering only small dimensional changes will occur. Typically it has been found that only approximately 0.3% shrinkage occurs on linear dimensions. The precise extent of dimensional movement will depend on sintering conditions employed, such as temperature, time and atmosphere, and on the specific alloying additions that are made. The sintered article will be approximately 90% of theoretical density and will be of substantially the same shape as the final sintered article. Additional processing allowances on dimensions are present and shall be more fully particularized herein.

The sintered article is then subject to forming operation in which dimensions are bought essentially to final requirements. In other words, dimensional control is accomplished in the moving of the sintered part during forming. Furthermore it is during the forming operation in which high density is imparted to the article. The forming operation is often referred to as coining, sizing, repressing or restriking. In essence all processes are carried out in a similar manner. The commonality is pressing of a sintered article within a closed rigid die cavity. In the high density forming operation the sintered article is pressed within a closed die cavity.

The closed die cavity of the forming operation is shown in FIG. 1. The closed rigid die cavity 10 is defined by spaced vertical die walls 12 and 14, lower punch or ram walls 16 and upper punch or ram 18. The sintered part is represented by 20. During the forming operation upper punch or ram 18 imparts a compressive force to sintered part 20. The closed die cavity is designed with a clearance 22 to permit movement of the ductile sintered material in a direction perpendicular to or normal to the compressive force as shown by arrow A. During compression the overall compressed length or height of the sintered article is shortened by the dimension S.

Conventional forming may permit shortening or movement of the sintered material in a direction A by 1 to 3%. The invention described herein permits movement of the sintered material beyond 3% of the original height or length. It is possible as shall be described herein that the shortening S or percentage closure of the die can reach as much as 30% shortening of dimension S. Particularly advantageous results are achieved by having a closure which represents a compressed length or height S between 3% to 19% of the original uncompressed length. In other words S represents the change in the overall height H of the sintered part to that of the compressed height CH. Moreover, the compression of the overall length or height collapses the microstructural pores in the sintered powder metal part and thereby densifies the sintered part.

Figure 2:
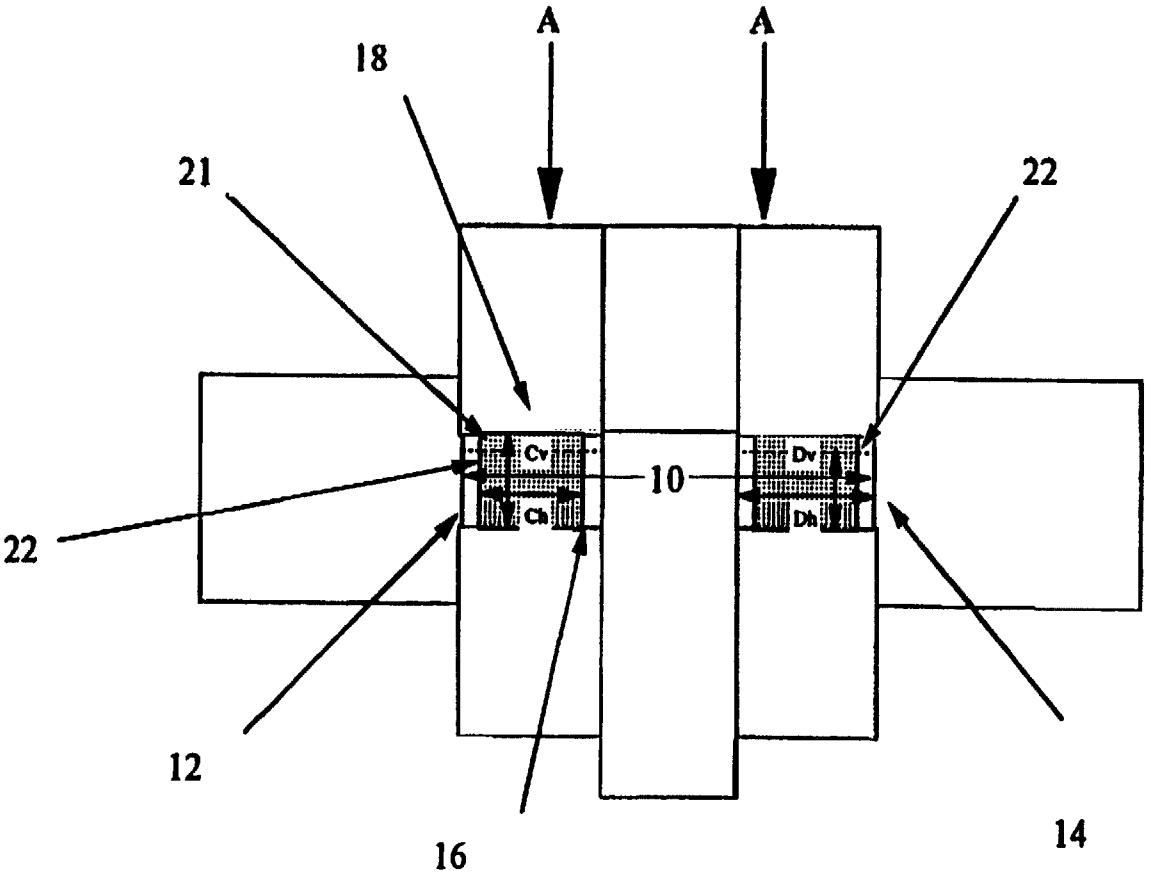
FIG. 2 is a cross sectional view of the forming process for a sintered ring.

Another example of the closed die cavity is shown in FIG. 2 where the closed rigid die cavity 10 is again defined by the spaced vertical die walls 12 and 14 respectively, the lower punch or ram wall 16 and upper punch or ram wall 18 and core 19. In this case the sintered part is represented by a ring 21 which has a hole 23 therethrough. Again during the forming operation upper punch or ram 18 imparts a compressive force A to the sintered ring 21. The closed die cavity is once again designed with a clearance 22 to permit movement of ductile sintered material in a direction perpendicular or normal to the compressive force A. Once formed or compressed the sintered material will move within the closed cavity from the position of the arrows $C_v$, $C_h$ to $D_v$ and $D_h$. In other words, the sintered material will move to fill the clearance 22 and move in the direction of hole 23. Upon compression the hole 23 will have a smaller internal diameter after the application of the compressive force. The compressed height of the sintered ring 21 can be reduced by approximately 3 to 19% of the uncompressed height. In the case shown in FIG. 2, the height of the ring also represents the height in the axial direction of the ring.

The tool clearance 22 depends on the geometry of the sintered part, and it is possible that one could have a different tool clearance 22 on the outside diameter of the part than the tool clearance on the inside diameter.

By utilizing a high ductile grade of sintered powder metal a part having a high density and high ductile sintered part is produced upon forming as described herein. During the forming step the microstructural pores collapse thereby providing a relatively higher density part. Accordingly, after heat treatment, a powder metal providing high ductility is utilized.

Particularly good results are achieved by utilizing alloying elements selected from the group of manganese, chromium, molybdenum, wherein the alloying element is in the form of a ferro alloy. In other words, the ferro alloy is selected from the group of ferro manganese, ferro chromium and ferro molybdenum. The selected ferro alloys are then blended with carbon and a lubricant with substantially pure iron powder so as to produce a sintered part having the following composition by weight to the total weight of sintered part where the total alloy content of the sintered part is between 0 to 2.5% by weight and the individual alloys have the following weight compositions:

| | |
|---|---|
| Mn | 0–1.5% |
| Cr | 0–1.5% |
| Mo | 0–1.5% |
| C | 0–0.5% |
| Fe and unavoidable impurities | remainder |

In other words the total alloy content is between 0 to 2.5% by weight and the individual alloy content of Mn, Cr, Mo are each between 0 to 1.5% with carbon between 0 to 0.5% of the total weight of the sintered part, with the remainder being substantially pure iron powder and unavoidable impurities.

The ranges referred to above include 0% weight of total alloy content so as to include the example of utilizing substantially pure iron powder with substantially no alloying additions (except unavoidable impurities) to produce a high density sintered powder metal having a density of at least 7.4 g/cc when formed in accordance with the teachings of this invention. Such part exhibits high density and good magnetic properties with high ductility.

In other examples, at least one alloying element will be selected from the group of FeMn, FeCr, FeMo, and then blended with carbon and a lubricant substantially pure iron powder so as to produce a sintered part having a total alloy composition (i.e. Mn, Cr, Mo, C) of up to 2.5% by weight of the total weight of the sintered part with the individual alloying elements having the following percent composition to total weight of the sintered part,

| | |
|---|---|
| Mn | 0–1.5% |
| Cr | 0–1.5% |
| Mo | 0–1.5% |
| C | 0–0.5% |
| Fe and unavoidable impurities | remainder |

Thereafter the sintered part is formed as described.

EXAMPLE

Carbon, a ferro alloy such as ferro manganese, is blended with lubricant and iron powder. An example of iron powder used is Hoeganaes Ancorsteel 1000/1000B/1000C or QMP Atomet 29 or QMP Atomet 1001. By way of example Mn may be added as FeMn, which contains 71% Mn. The particle size of the FeMn will generally be within the range of 2 to 20 μm.

The iron powder is substantially pure iron powder with preferably less than 1% of unavoidable impurities. The particle size of the iron powder will have a distribution range of 10 to 350 μm. Lubricant used may be zinc stearate. The blended mixture is compacted in a press with compacting pressure of about 40 tons per square inch to produce a green compact with a density of approximately 90% of theoretical. The compacted part is then sintered at a temperature greater than 1250° C. for a time duration of approximately 20 minutes. Sintering can occur at a temperature between 1250° C. and 1380° C. The quantity of carbon, ferro manganese and iron powder is selected so as to produce a sintered powder metal part having the following composition by weight to the weight of the total sintered part namely:

| | |
|---|---|
| C | 0.2% |
| Mn | 0.7% |
| Fe and unavoidable impurities being the remainder | |

The sintered part is then formed as previously described in a closed die cavity which defines the final net shape part. The closed die cavity will have a clearance designed for movement of the ductile sintered powder metal to collapse the pores and thereby increase the density of the formed sintered powder metal part.

FORMING

Particular examples including the forming step shall now be described.

Figure 3:
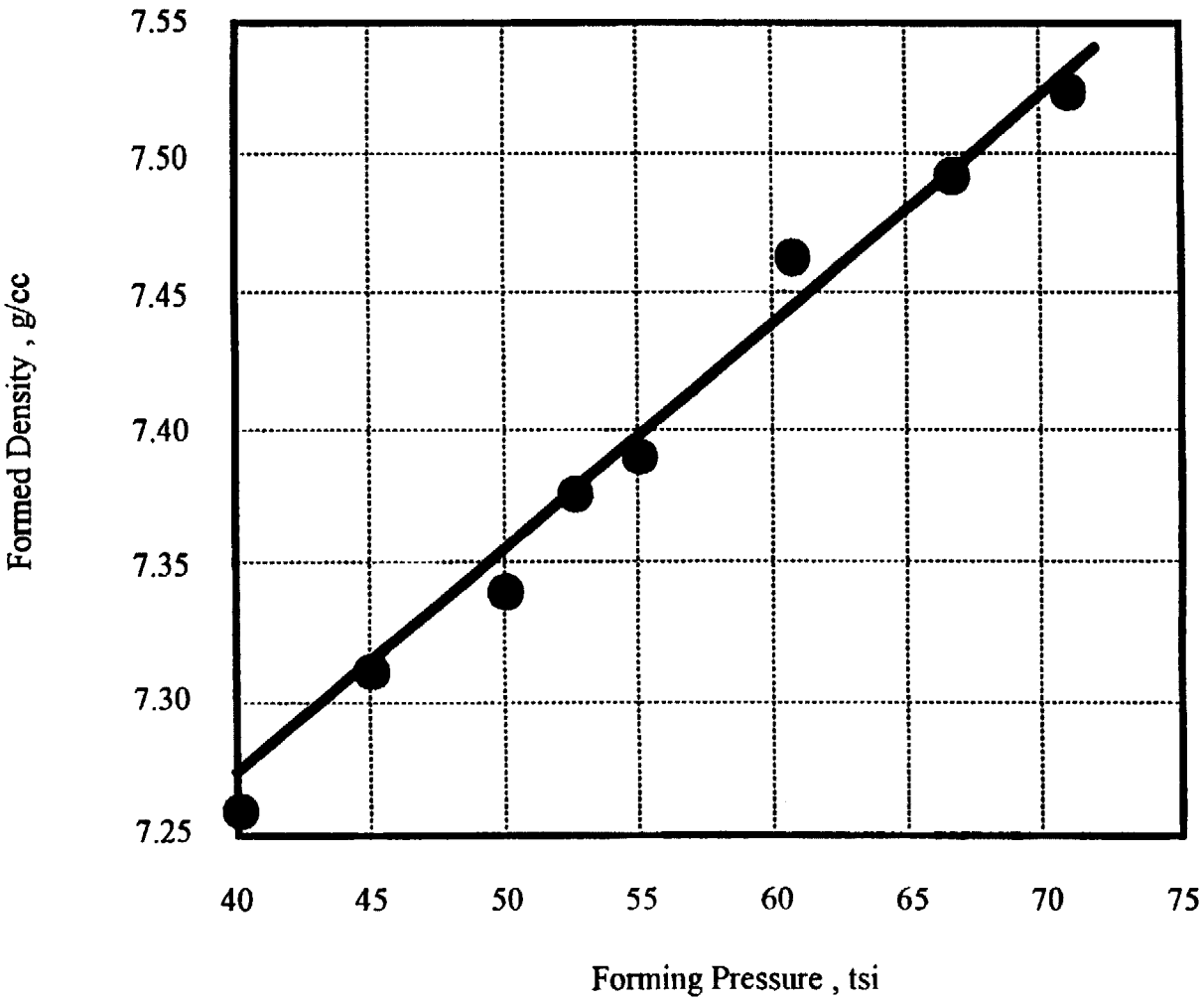
FIG. 3 is a graph of the high density forming of C—Mn test bars.

FIG. 3 shows the forming or coining of sintered powder metal test bars or rings produced as shown in FIGS. 1 or 2 respectively having a carbon and manganese content. FIG. 3 shows that when the test bar or ring is subject to an increase in the coining or forming pressure between 40 and 75 tons per square inch the formed sintered part will have a resultant increase in density of approximately 7.25 to just over 7.50 g/cm$^3$. In other words with an increase in forming pressure an increase in formed density occurs. The density of the C—Mn test bars will approach the theoretical density of wrought steel. In the examples outlined herein forming occurs at ambient temperature although in another embodiment forming could occur at an elevated temperature.

Figure 4:
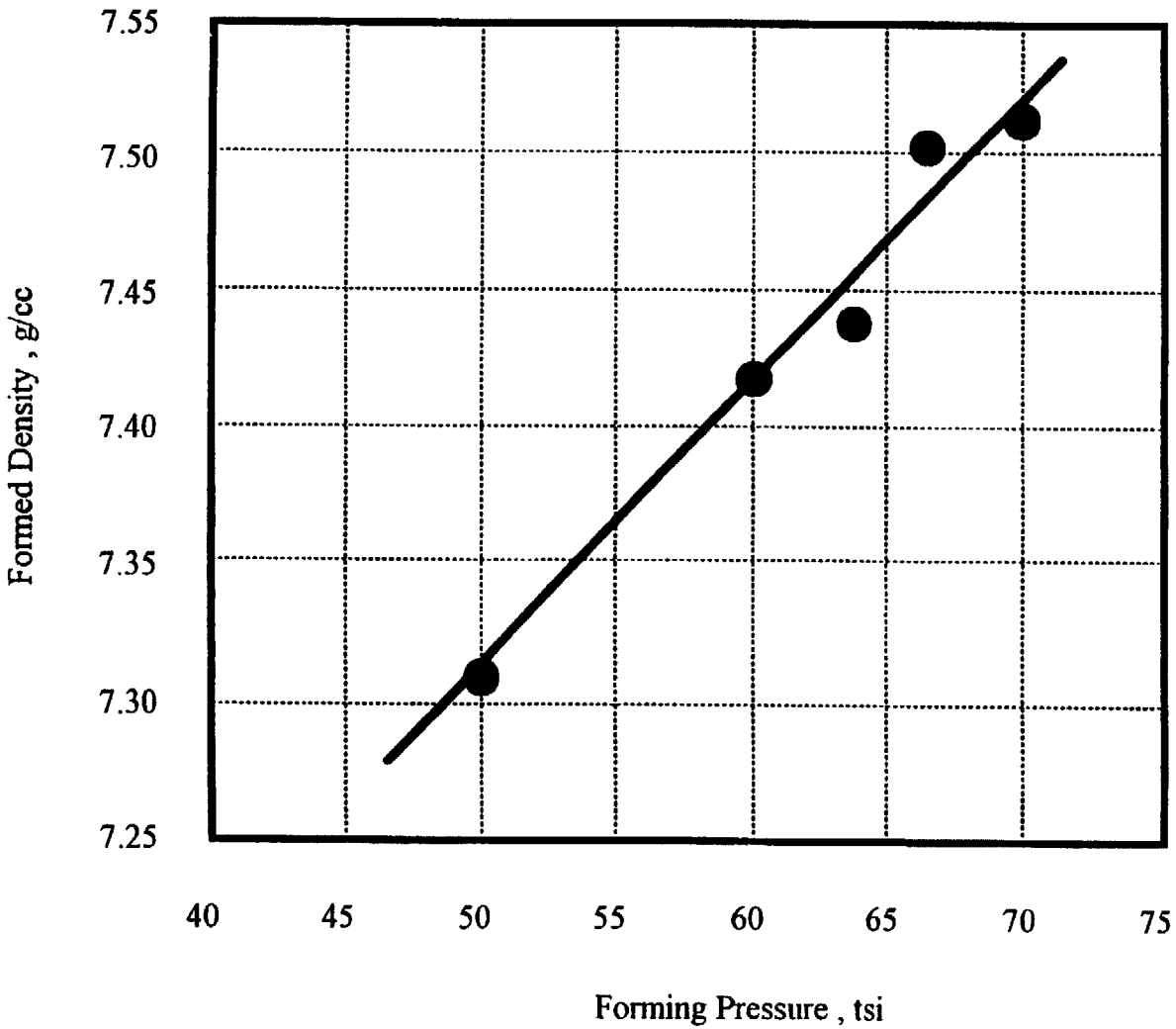
FIG. 4 is a graph of the high density forming of a clutch plate.

FIG. 4 is a chart that shows the impact of forming pressure to the formed density of a sintered part comprised of C—Mn. FIG. 4 generally illustrates that with an increase in forming pressure an increase in formed density will be observed as illustrated therein.

Figure 5:
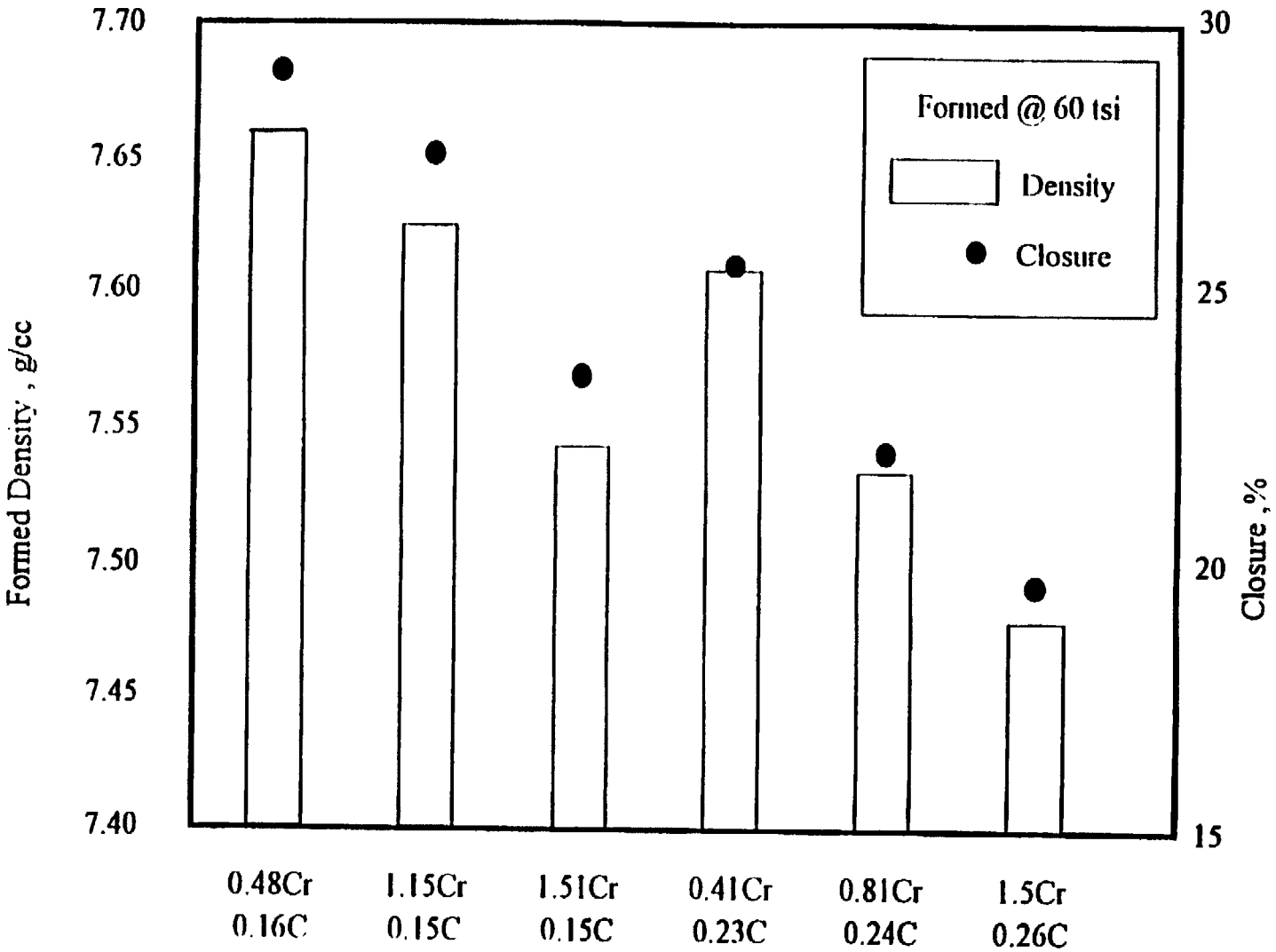
FIG. 5 is a graph of formed density and closure of C—Cr rings coined at 60 tsi.

FIG. 5 illustrates formed density and closures for C—Cr powder metal parts which are coined at 60 tons per square inch. The first bar graph to the left shows that a sintered powder metal part having 0.48% chromium and 0.16% carbon with the remainder being essentially iron and unavoidable impurities when formed or coined at 60 tons per square inch produces a formed sintered part having a density of over 7.65 g/cc. The closure or the amount of shortening S of the compressed height verses the uncompressed height of the sintered ring approaches approximately 30%. In other words, the inside diameter of the ring 21 was sufficiently large and the clearance designed so as to produce a closure or shortening of almost 30% in the compressed height verses the uncompressed height of the formed sintered ring. The second bar graph illustrates a sintered part having 1.15% chromium to 0.15% carbon to the total weight of the sintered part which is coined at 60 tons per square inch so as to produce a formed sintered part having a density of approximately 7.625 g/cc. The closure of the shortening in the height S of the same sized ring 21 is slightly lower at 28%.

The third bar graph shown in FIG. 5 shows a sintered part having 1.51% chromium and 0.15% carbon with the remainder being iron and unavoidable impurities which has been coined at 60 tons per square inch so as produce a part having a density of approximately 7.525 g/cc. The closure is approximately 25%. Three other results are also shown in FIG. 5.

Figure 6:
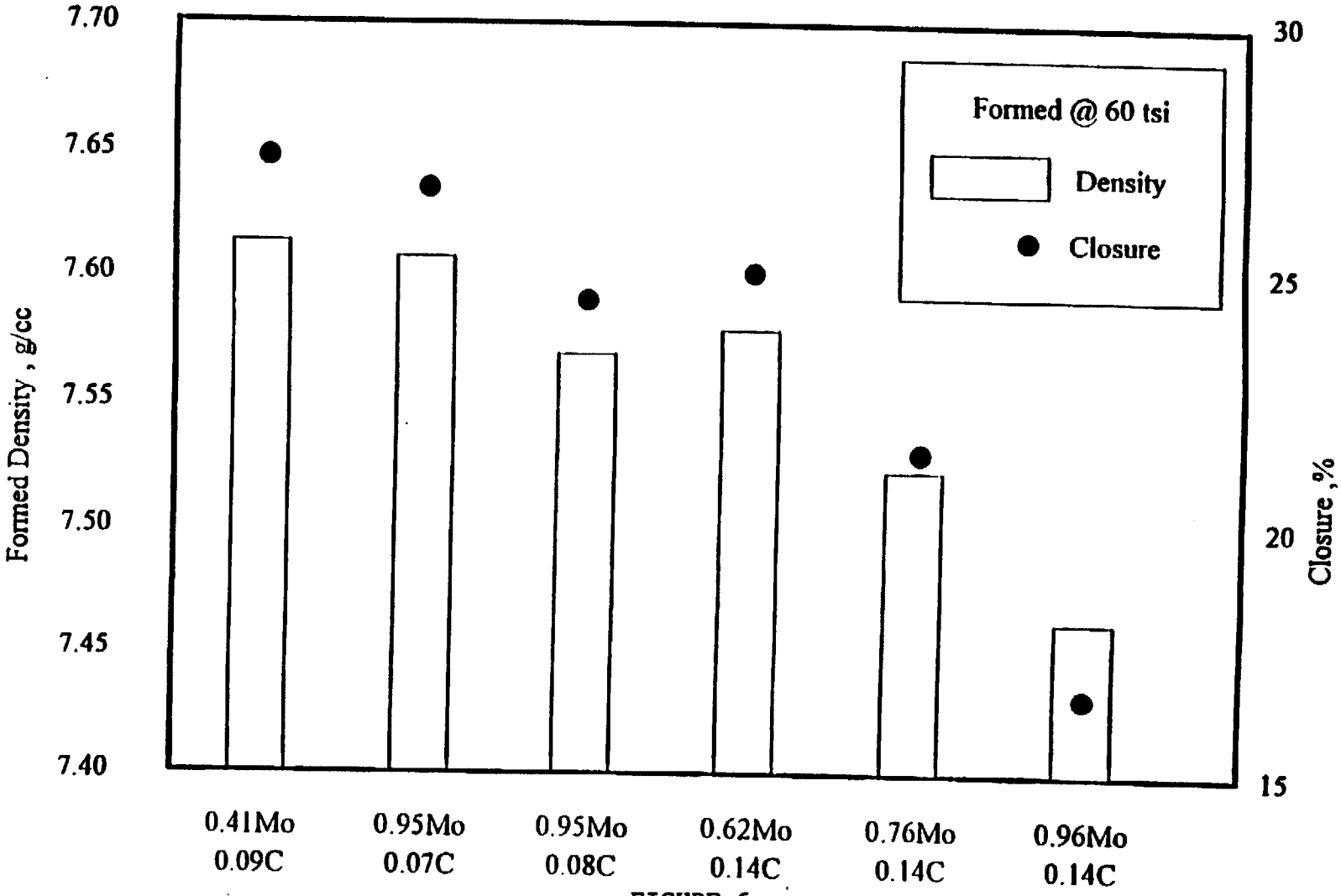
FIG. 6 is a graph of formed density and closure of C—Mo rings coined at 60 tsi.

FIG. 6 is another graph showing the coining density and closure of C—Mo powder metal which has been coined at 60 tons per square inch. Generally speaking, higher concentrations of molybdenum will decrease the density of the coined part as well as provide a smaller degree of closure. For example, a sintered part having 0.41% by weight of molybdenum and 0.09% carbon with the remainder being iron once coined at 60 tons per square inch produces a part having a density of slightly greater than 7.60 g/cc. Closure is approximately 28%.

Figure 7:
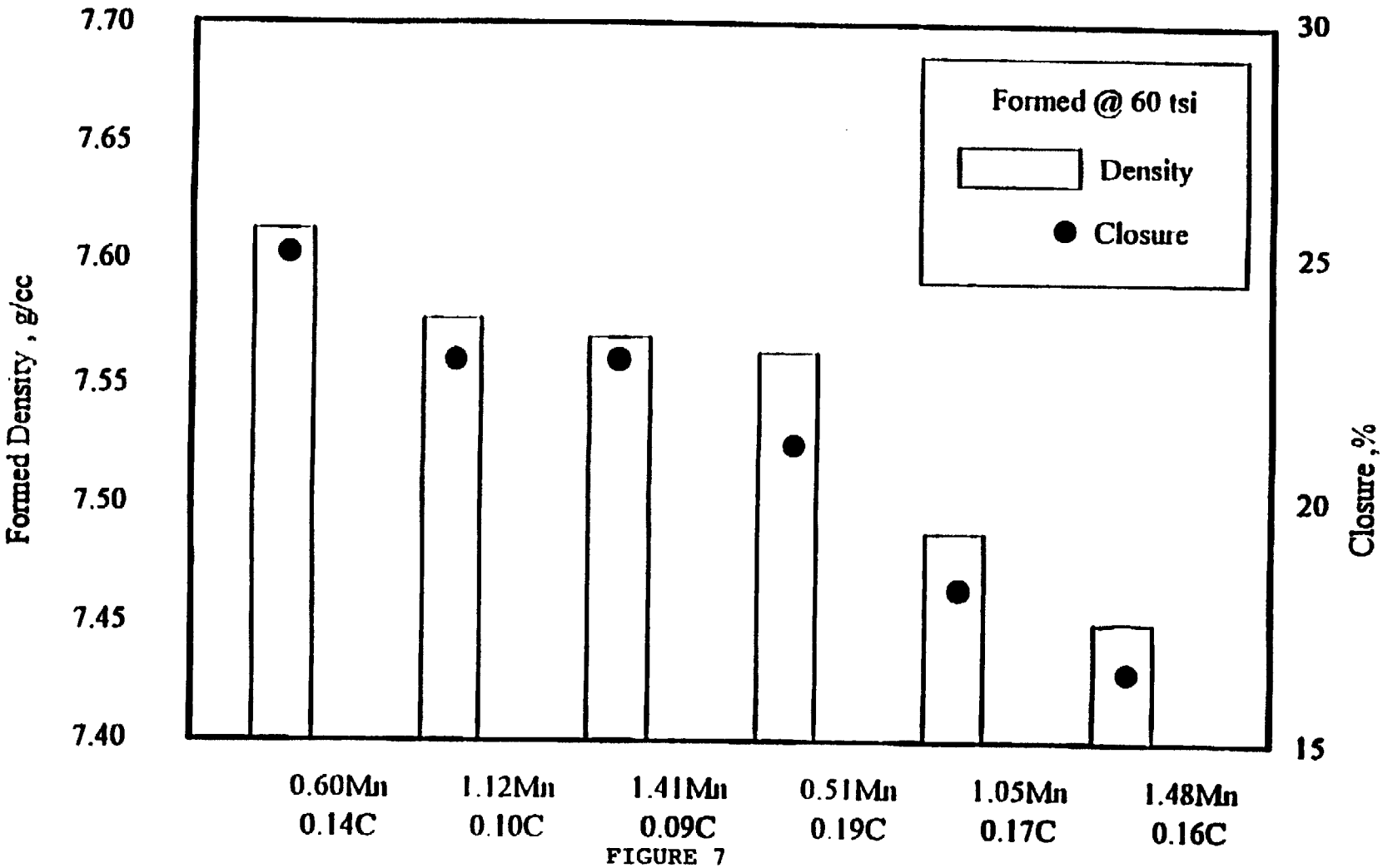
FIG. 7 is a graph of formed density and closure of C—Mn rings at 60 tsi.

FIG. 7 illustrates the coin density and closure C—Mn powder metal coined at 60 tons per square inch. Generally speaking higher concentrations of manganese reduce the density of the formed sintered part and permit less closure.

The foregoing shows that by controlling the chemical composition of the sintered article, and by controlling the pressing forces and clearance in a closed die cavity, a remarkable increase in density can be achieved. FIGS. 3 to 7 show the densities and closures that can be achieved when using singular combinations of the ferro alloys namely FeMo, FeCr and FMn with base iron powder. It is of course possible as described above to use more than one ferro alloy, ie FeMo, FeCr, FeMn with base iron powder as desired to achieve functional requirements of the manufactured article. In other words separate ferro alloys of FeMo, FeCr and FeMn may be admixed with base iron powder.

Figure 8:
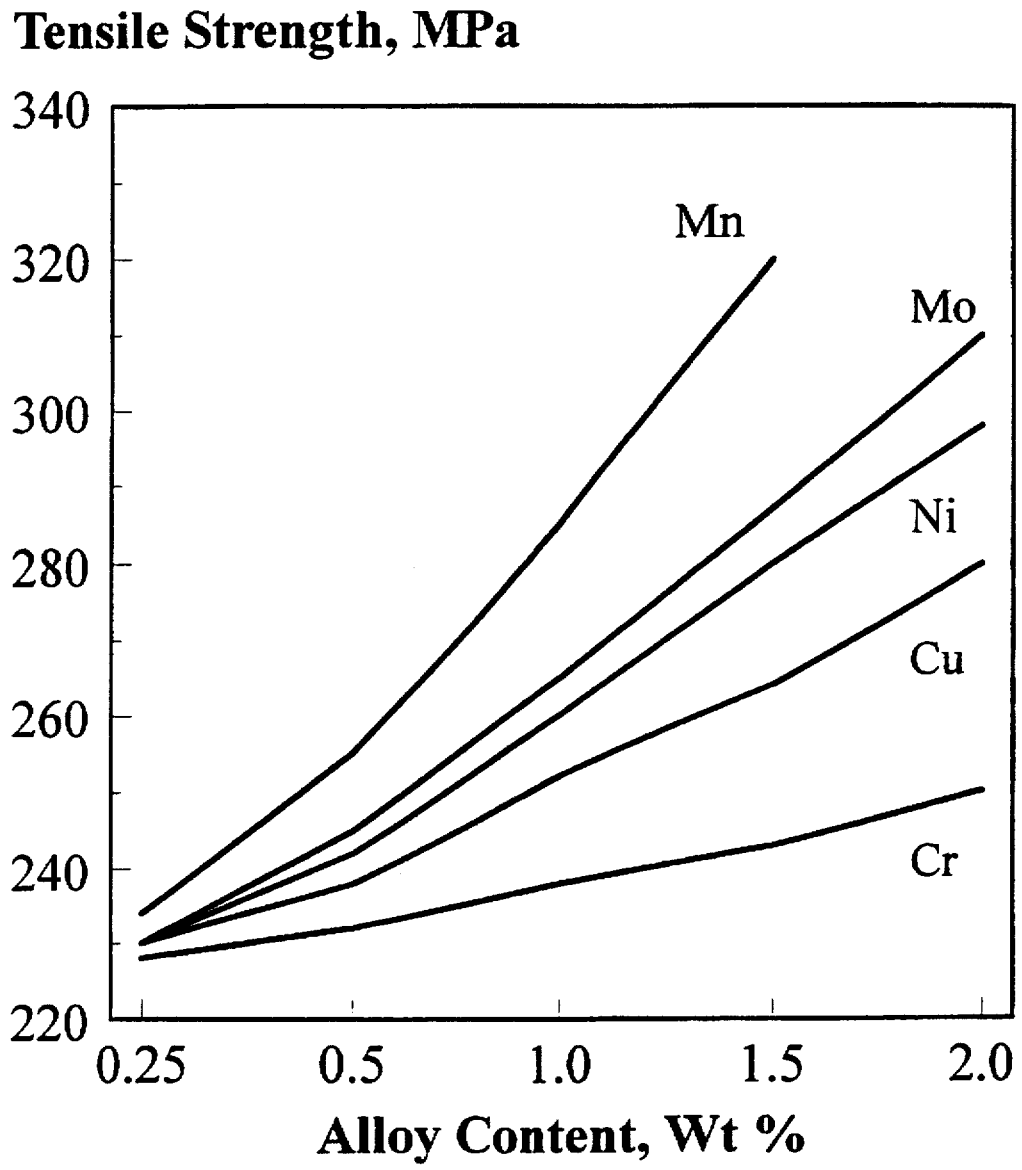
FIG. 8 is a graph of strength versus percent alloy in iron.
Figure 9:
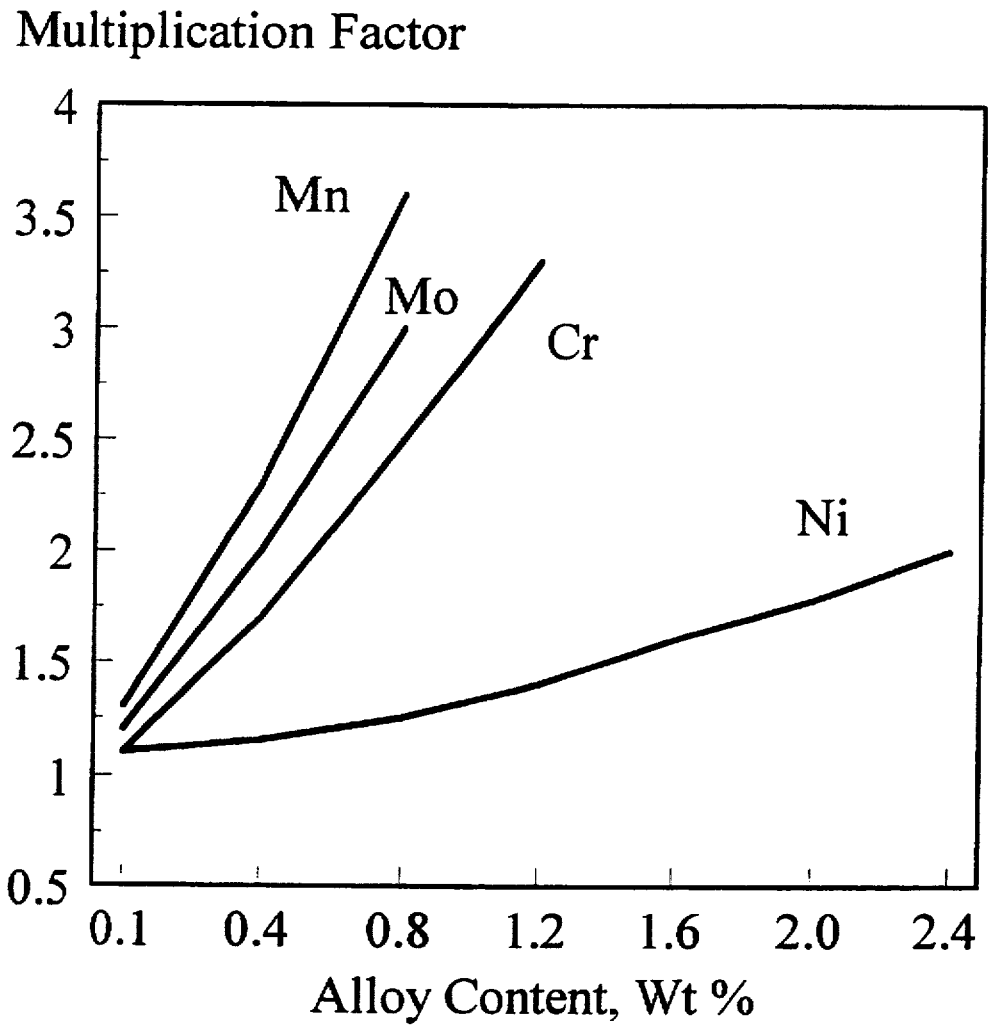
FIG. 9 is a graph of hardenability versus percent alloy in iron.

FIGS. 8 and 9 generally show the effect that the percentage of the alloyed ingredients Mn, Mo, Ni and Cr has on the strength and hardenability of the sintered part.

FIG. 8 shows that the addition of manganese has a greater effect on the tensile strength of the metal powder metal part than molybdenum, chromium or nickel.

FIG. 9 generally shows that manganese increases the hardenability of the sintered powder metal articles more than molybdenum. The addition of molybdenum has a greater effect on the hardenability of the sintered powder metal part than chromium or nickel. Furthermore one should be careful not to add a lot of manganese as this may hinder the forming operation as Mn has a strong effect on the strength. In particular no more than 1.5% of Mn should be included in the total weight of the sintered powder metal article. For example, one may use Cr since at a given composition Cr does not increase the strength of the sintered article as much as Mn (see FIG. 8) but does impart high hardenability (see FIG. 9).

TOOLING

High quality tooling is generally used.

HEAT TREATMENT

Figure 10:
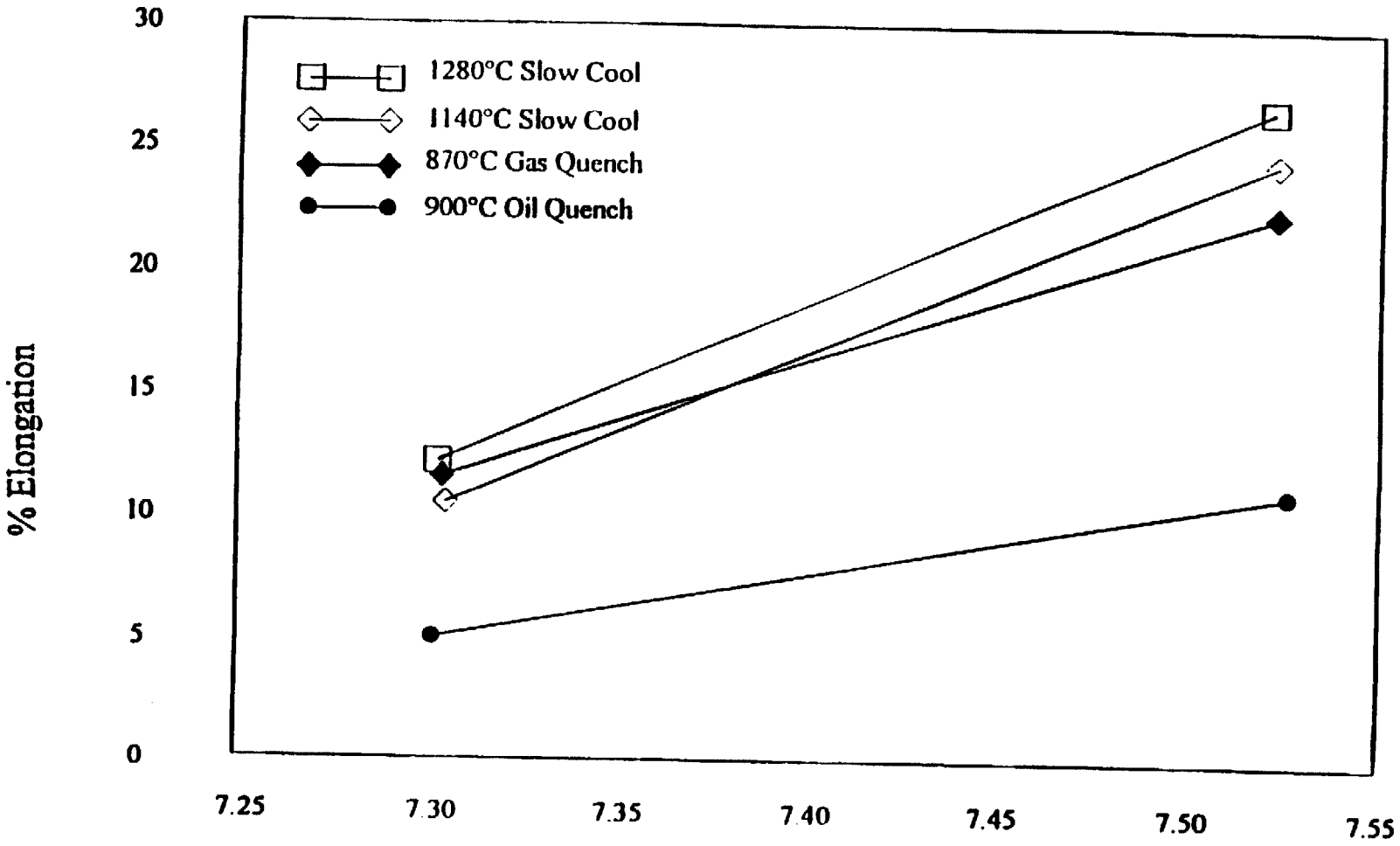
FIG. 10 is a graph of elongation of FC—Mn tensile specimens with different heat treatments.
Figure 11:
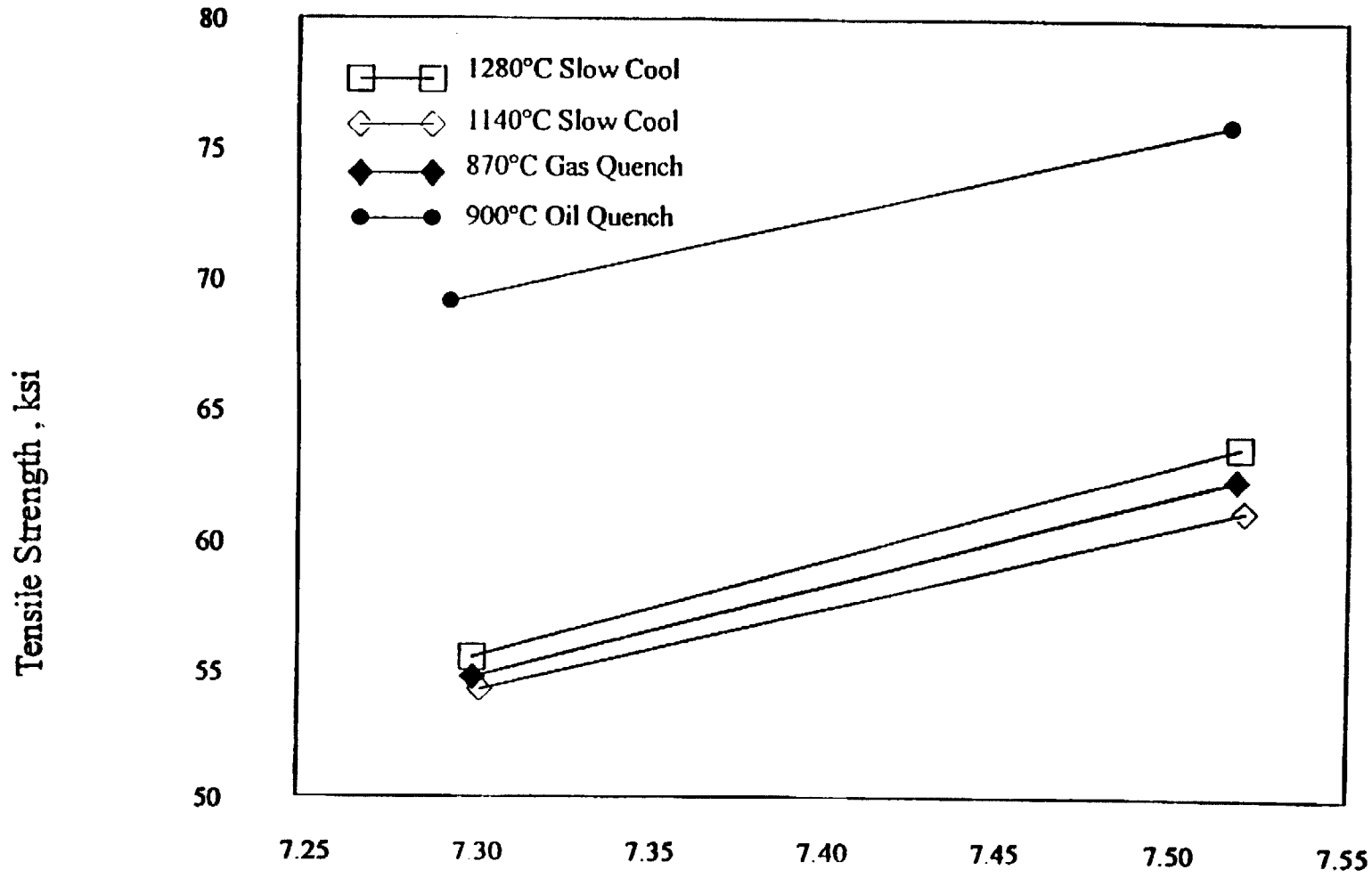
FIG. 11 is a graph of tensile strength of C—Mn specimens with different heat treatments.

Subsequent to the forming operation, in order to develop the full mechanical properties of the article, it may be necessary to subject the article to heat treatment operation. The heat treatment operation is generally carried out within the temperature range of 800° C. to 1300° C. The attached FIGS. 10 and 11 indicate the effect of heat treatment conditions on the final mechanical properties of the article. The conditions may be varied within the above range to suit the desired functional requirements of the specific article. It is also preferable to use a protective atmosphere during the annealing process. The atmosphere prevents oxidization of the article during the exposure to the elevated temperature of the heat treatment process. The actual atmosphere used may consist of hydrogen/nitrogen blends, nitrogen/exothermic gas blends, nitrogen/endothermic gas blends, dissociated ammonia or a vacuum. In the heat treatment stage it is generally preferable to maintain a neutral atmosphere in terms of carbon potential with respect to the carbon content of the article. In special instances, for example should the article require high wear resistance, a carburizing atmosphere may be used during heat treatment. The carburizing atmosphere may consist of methane or propane where the carbon atoms will migrate from the methane or propane to the surface layers of the article. In such an operation, carbon will be introduced into the surface layers of the article. If the article is subsequently quenched, a case hardened product can be produced with beneficial wear resistant properties.

The heat treatment process specifically causes metallurgical bonding within the densified article. After forming, there is no metallurgical bonding between the compressed powder particles. Such a structure, while having high density, will generally not demonstrate good mechanical properties. At the elevated temperature of the heat treatment process, the cold worked structure will recrystallize and metallurgical bonding occurs between the compressed particles. After completion of the metallurgical bonding process, the article will demonstrate remarkable ductility properties which are unusual for sintered PM articles.

After the heat treatment, the article is ready for use and will exhibit mechanical properties that are generally very similar to wrought steel of the same chemical composition. FIG. 12 shows typical mechanical properties of a material manufactured by the invented process. The remarkable ductility, impact strength and fatigue strength to tensile strength ratio are a typical consequence of the new process. As can be seen from the comparative chart for regular PM materials (represented by the designation FC0200), which are typically manufactured to around 90% of theoretical density, the previously described mechanical properties are significantly improved. For example FIG. 12 shows the mechanical properties of a Fe C Mn (0.2 C and 0.7 Mn) produced by the invention described herein versus the mechanical properties of a regular PM material such as FC0200 (having a low carbon 0–0.3% C and low alloy material i.e. 1.5 to 3.9% by weight copper) versus the mechanical properties of wrought steel having the designation AISI 1020. The unnotched impact strength of Fe C Mn at greater than 120 ft lb and the elongation at 23% are notable. Fatigue properties were determined by three point bending. The high density point also produces a significant improvement in elastic modulus.

If further mechanical property enhancement is required, for example in gear wheel, sprocket or bearing type applications, a selective densification process as described in U.K. patent G.B. 2,550,227B, 1994 may be utilized, which consists of densifying the outer surface of the gear teeth by a single die or twin die rolling machine and may include separate and or simultaneous root and flank rolling. In each case the rolling die is in the form of a mating gear made from hardened tool steel. In use the die is engaged with the sintered gear blank, and as the two are rotated their axis are brought together to compact and roll the selected areas of the gear blank surface.

The process as described herein can be utilized to produce a number of products including clutch backing plates, sprockets and transmission gears. Since sprockets and transmission gear generally require high wear resistance a carburizing atmosphere may be used during heat treatment. Transmission gears generally require hardened surfaces and hardened cores, and accordingly agents for increasing hardenability such as chromium or molybdenum can be added.

Although the preferred embodiment as well as the operation and use have been specifically described in relation to the drawings, it should be understood that variations in the preferred embodiment could be achieved by a person skilled in the trade without departing from the spirit of the invention as claimed herein.

The embodiments of the invention in which an exclusive property or privilege is claimed are defined as follows:

1. A method of forming sintered powder metal articles to a high density by forming the sintered powder metal in a closed die cavity having a clearance for movement of said sintered powder metal to final shape with increased density after compression wherein the formed sintered powder metal part has a compressed length of approximately 3 to 30% less than the original length.

2. The method of claim 1 wherein the formed sintered powder metal part has a compressed length of approximately 3 to 19% less than the original length.

3. The method of claim 2 wherein said sintered formed powder metal part has a total alloy composition between 0 to 2.5% by weight to the total weight of sintered metal article, with the individual alloying elements having the following percent composition to the total weight of the sintered part: Mn 0–1.5%; Cr 0–1.5%; Mo 0–1.5%; C 0–0.5%; Fe and unavoidable impurities being the remainder.

4. The method of claim 3 wherein said sintered powder metal is produced by:

(a) blending:
  (i) carbon
  (ii) at least one ferro alloy selected from the group of ferro molybdenum, ferro chromium and ferro manganese;
  (iii) a lubricant, with
  (iv) iron powder.

(b) pressing said blended mixture to form said article (c) sintering said compact at a temperature greater than 1250° C.

5. A method of forming sintered powder metal article by:

(a) blending
  (i) carbon
  (ii) at least one ferro alloy powder selected from the group of ferro chromium, ferro manganese, ferro molybdenum, and
  (iii) a lubricant, with
  (iv) iron powder to form a blended mixture;
(b) pressing said blended mixture to form said article;
(c) sintering said article at a temperature greater than 1250° C.;
(d) forming said sintered article in a closed die cavity having a clearance so as to produce a formed sintered powder metal part having a compressed length of approximately 3 to 19% less than the original length when subjected to a pressure between 40 and 90 tons per square inch so as to increase the density of said formed sintered article;
(e) annealing said formed sintered article at a temperature greater than 800° C. in a reducing or carburizing atmosphere or vacuum.

6. The method of claim 5 wherein said blended powder metal is pressed to approximately 90% of theoretical density.

7. The method of claim 6 wherein said sintered powder metal is formed to a density of at least 94% of theoretical density.

8. The method of claim 7 where said sintered powder metal has at least one alloy selected from the group of Mn, Mo, Cr, and C with a total alloy composition up to 2.5% by weight to the total weight of sintered part and the remainder of said sintered article has the following weight composition:

| | |
|---|---|
| Mn | 0–1.5% |
| Cr | 0–1.5% |
| Mo | 0–1.5% |
| C | 0–0.5% |
| Fe and unavoidable impurities | remainder. |

9. The method of claim 8 wherein said closed die cavity has a clearance so as to permit said sintered powder metal to move within said closed die cavity where said sintered powder metal part is compressed so as to reduce the compressed length of said article between 3 to 19%.

10. The method of claim 9 wherein said formed sintered powder metal article has the following weight by composition to the total weight:

| | |
|---|---|
| C | 0.2% |
| Mn | 0.7% |
| Fe and unavoidable impurities being the remainder. | |

11. The method of claim 10 wherein said formed sintered powder metal articles have a density between 7.4 to 7.7 g/cc.

12. The method of claim 11 to produce a transmission gear.

13. The method of claim 11 to produce a sprocket.

14. The method of claim 11 to produce a clutch backing plate.

15. The method of claim 11 to produce a sintered powder metal article with magnetic properties.

16. A method of making a high density sintered powder metal article, comprising the steps of:

(a) blending iron powder with ferro alloys, graphite and lubricant to provide a selected chemical composition for the finished article having at least one of the following: 0 to 0.5% carbon, 0 to 1.5% manganese, 0 to 1.5% molybdenum and to 1.5% chromium and the remainder iron powder with unavoidable impurities;
(b) compacting the metal powder mixture in a rigid die to a density of approximately 90% of theoretical full density;
(c) sintering the compacted article at a temperature greater than 1250° C. in a reducing atmosphere or vacuum;
(d) forming the sintered article in rigid tools at pressure in the range of 40 to 90 tons per square inch to a density in excess of 94% of theoretical full density by axial compression allowing radial expansion to decrease the axial length of the sintered article by approximately 3 to 30% of the original length.
(e) annealing the high density article at a temperature greater than 800° C. in a reducing or carburizing atmosphere or vacuum;

where the total alloy composition is between 0 to 2.5% by weight to the total weight of sintered powder metal article.

* * * * *